US008517124B2

(12) United States Patent
Hareland et al.

(10) Patent No.: US 8,517,124 B2
(45) Date of Patent: Aug. 27, 2013

(54) PDC DRILL BIT WITH FLUTE DESIGN FOR BETTER BIT CLEANING

(75) Inventors: Geir Hareland, Calgary (CA); Jeff Janzen, Leduc (CA)

(73) Assignee: NorthBasin Energy Services Inc., Edmonton, Alberta ( * ) Notice: Subject to any disclaimer, the term of this patent is extended or adjusted under 35 U.S.C. 154(b) by 7 days.

(21) Appl. No.: 12/628,956

(22) Filed: Dec. 1, 2009

(65) Prior Publication Data

US 2011/0127087 A1 Jun. 2, 2011

(51) Int. Cl.
*E21B 10/60* (2006.01)

(52) U.S. Cl.
USPC ..... 175/393; 175/428

(58) Field of Classification Search
USPC ..... 175/393, 428, 385, 408
See application file for complete search history.

(56) References Cited

U.S. PATENT DOCUMENTS

| | | | | |
|---|---|---|---|---|
| 3,216,514 | A | 11/1965 | Nelson et al. | |
| 3,402,780 | A * | 9/1968 | Goodwin et al. | 175/67 |
| 3,419,094 | A * | 12/1968 | Bobo | 175/325.2 |
| 3,548,959 | A * | 12/1970 | Hasiba | 175/393 |
| 3,610,347 | A | 10/1971 | Hinks et al. | |
| 3,897,836 | A | 8/1975 | Hall et al. | |
| 4,114,705 | A | 9/1978 | Milan | |
| 4,185,706 | A | 1/1980 | Baker et al. | |
| 4,494,618 | A * | 1/1985 | Radtke | 175/393 |
| 4,673,045 | A | 6/1987 | McCullough | |
| 4,775,016 | A | 10/1988 | Barnard | |
| 4,819,745 | A | 4/1989 | Walter | |
| 5,067,655 | A | 11/1991 | Farago et al. | |
| 5,197,554 | A * | 3/1993 | Zijsling | 175/393 |
| 5,495,903 | A | 3/1996 | Griffin et al. | |
| 5,538,093 | A | 7/1996 | Siracki et al. | |
| 5,678,645 | A | 10/1997 | Tibbitts et al. | |
| 5,775,443 | A | 7/1998 | Lott | |
| 5,862,871 | A | 1/1999 | Curlett | |
| 5,906,245 | A | 5/1999 | Tibbitts et al. | |
| 5,992,763 | A | 11/1999 | Smith et al. | |
| 6,021,858 | A * | 2/2000 | Southland | 175/431 |
| 6,062,325 | A * | 5/2000 | Taylor et al. | 175/393 |
| 6,079,507 | A * | 6/2000 | Trujillo et al. | 175/57 |
| 6,082,473 | A | 7/2000 | Dickey | |
| 6,129,161 | A * | 10/2000 | Roberts et al. | 175/393 |
| 6,142,248 | A | 11/2000 | Thigpen et al. | |
| 6,354,387 | B1 | 3/2002 | Harris et al. | |
| 6,470,980 | B1 | 10/2002 | Dodd | |

(Continued)

FOREIGN PATENT DOCUMENTS

| | | |
|---|---|---|
| CA | 2121232 | 4/1993 |
| CA | 2557947 | 5/2009 |

(Continued)

OTHER PUBLICATIONS

"Oil & Gas Well Drilling Bits: Diamond-Core-Carbide-Rock Drill Bit", Slimhole Drilling [online], http://www.slimhole.org/core-drill-bits-diamond-bit.htm, Dec. 2009.

*Primary Examiner* — Nicole Coy
(74) *Attorney, Agent, or Firm* — Anthony R. Lambert

(57) ABSTRACT

A drill bit is disclosed, comprising: a drill bit head having a cutting face with one or more fixed cutting elements; a flow passage extending from the center towards the gage of the bit which has been designed to increase the velocity across the cutting elements.

10 Claims, 6 Drawing Sheets

(56) References Cited

U.S. PATENT DOCUMENTS

| | | | | |
|---|---|---|---|---|
| 6,581,702 | B2 | 6/2003 | Dickey | |
| 6,585,063 | B2 | 7/2003 | Larsen | |
| 6,668,948 | B2 | 12/2003 | Buckman et al. | |
| 6,698,538 | B2 * | 3/2004 | Kristiansen et al. | 175/340 |
| 6,772,849 | B2 | 8/2004 | Oldham et al. | |
| 6,986,297 | B2 | 1/2006 | Scott | |
| 7,188,682 | B2 | 3/2007 | Larsen et al. | |
| 7,325,632 | B2 | 2/2008 | Larsen et al. | |
| 7,343,987 | B2 | 3/2008 | Tibbitts | |
| 7,398,838 | B2 | 7/2008 | Harder et al. | |
| 7,571,782 | B2 | 8/2009 | Hall et al. | |
| 2002/0092684 | A1 | 7/2002 | Singh et al. | |
| 2002/0148649 | A1 | 10/2002 | Dickey | |
| 2003/0010532 | A1 | 1/2003 | Kristiansen et al. | |
| 2003/0192718 | A1 | 10/2003 | Buckman, Sr. et al. | |
| 2007/0221406 | A1 | 9/2007 | Hall et al. | |
| 2008/0230278 | A9 * | 9/2008 | Hoffmaster et al. | 175/408 |
| 2008/0314645 | A1 * | 12/2008 | Hall et al. | 175/374 |

FOREIGN PATENT DOCUMENTS

| | | | |
|---|---|---|---|
| EP | 0370709 | B2 | 6/1989 |
| EP | 0333454 | A2 | 9/1989 |
| EP | 0607135 | | 7/1994 |
| GB | 2104942 | A | 3/1983 |

* cited by examiner

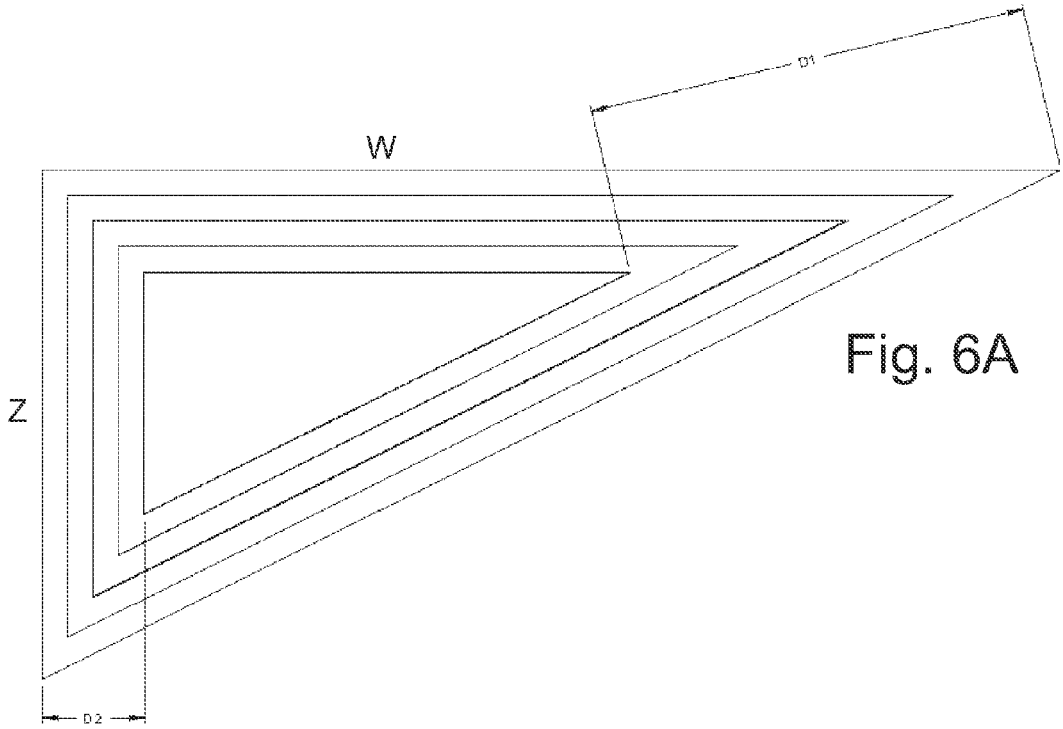
Fig. 6A
Fig. 6B
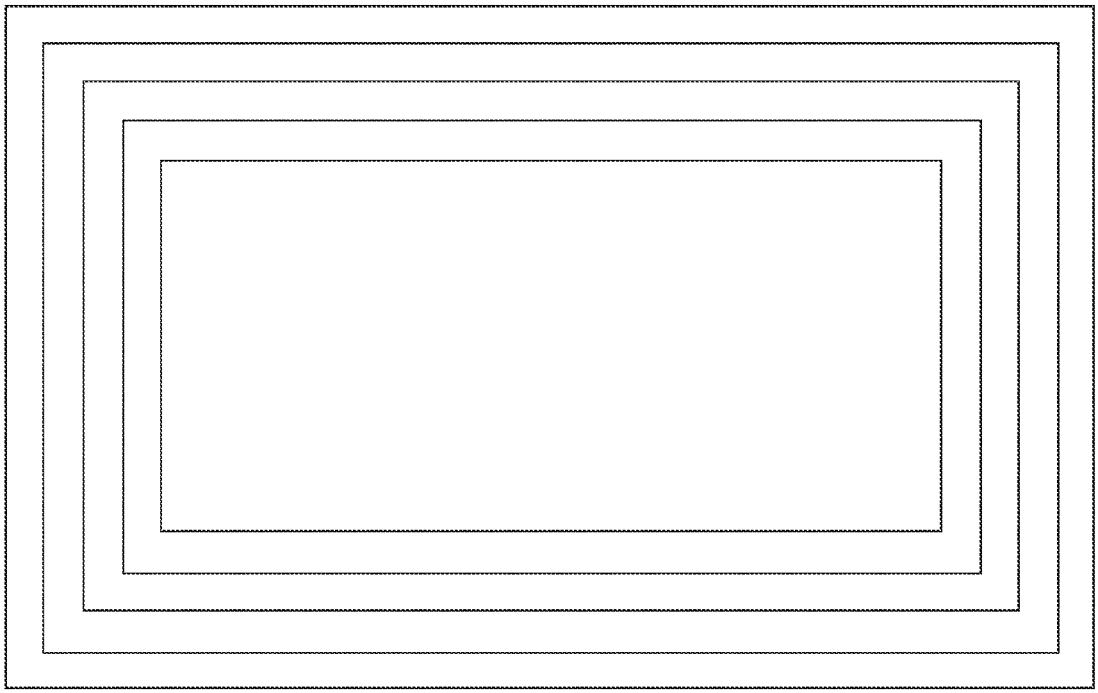

PDC DRILL BIT WITH FLUTE DESIGN FOR BETTER BIT CLEANING

TECHNICAL FIELD

This document relates to drill bits, and more specifically to PDC drill bits with specially designed flutes on the bit face for better bit cleaning.

BACKGROUND

PDC drill bits are used to drill wellbores through earth formations.

PDC drill bits are commonly known as fixed cutter or drag bits. Bits of this type usually include a bit body upon which a plurality of fixed cutting elements are disposed. Most commonly, the cutting elements disposed about the drag bit are manufactured of cylindrical or disk-shaped materials known as polycrystalline diamond compacts (PDCs). PDC cutters drill through the earth by scraping/shearing away the formation rather than pulverizing/crushing it. Fixed cutter and drag bits are often referred to as PDC or natural diamond (NDB) and impregnated bits. Like their roller-cone counterparts, PDC and in some cases NDB and impregnated bits also include an internal plenum through which fluid in the bore of the drill string is allowed to communicate with a plurality of fluid nozzles.

PDC drill bits may have flow passages terminating in jet nozzles out of which fluids flow to clear drill cuttings from the bottom of the bore being drilled and to cool the PDC cutters.

SUMMARY

Disclosed are drill bits that incorporate one or more flutes from a nozzle on the cutting face, in which the flutes are designed to maximize one or more of the fluid speed and the fluid turbulence across one or more fixed cutting elements, such as PDC cutters, on the cutting face adjacent the flute. In some embodiments, the flute may be a junk slot, for example located on an outer gage of the drill bit head.

Disclosed are drill bits that incorporate a flute design that increases, relative to a standard drill bit flute, a) the fluid velocity across the fixed cutting elements, and/or b) the turbulence of the fluid crossing the fixed cutting elements.

In an embodiment, there is provided a drill bit comprising a drill bit head having cutting blades, each pair of adjacent cutting blades defining a flute between the adjacent cutting blades, the cutting blades and flutes each extending radially outward from a central area of the drill bit head and each cutting blade having a front face and a back face, each front face of the cutting blades incorporating cutting elements. At least a nozzle is provided in each flute directed at least in part towards one or more cutting elements. Each flute has a sloping base, a maximum depth and a circumferential width at each of the cutting elements towards which the respective nozzle is directed. Each flute has a reduced cross-section perpendicular to flow along the flute at each of the one or more cutting elements. The cross-section is smaller in area than the area of an annular segment having a constant radial depth and circumferential width equal to the maximum depth and circumferential width of the flute at each of the one or more cutting elements. The reduction may be at least for example 15%, 25%, 30%, 35% or 50%.

A drill bit is also disclosed, comprising: a drill bit head having a cutting face with one or more fixed cutting elements; a flow passage extending from the center towards the gage of the bit which has been designed to maximize the velocity across the cutting elements.

A drill bit is also disclosed, comprising: a drill bit head having a cutting face with one or more fixed cutting elements; and a flute or flow channel passage extending from the center of the bit to the gage. The cross-sectional area is designed so that the velocity is increased at the cutting face. The cross-sectional area is designed so that the maximum velocity change is at the cutting face.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIGS. 6A-B are diagrams that illustrate lines of constant flow in the drill bit flue model of the embodiments disclosed herein (FIG. 6A), and a standard drill bit flute (FIG. 6B).

DETAILED DESCRIPTION

Figure 2:
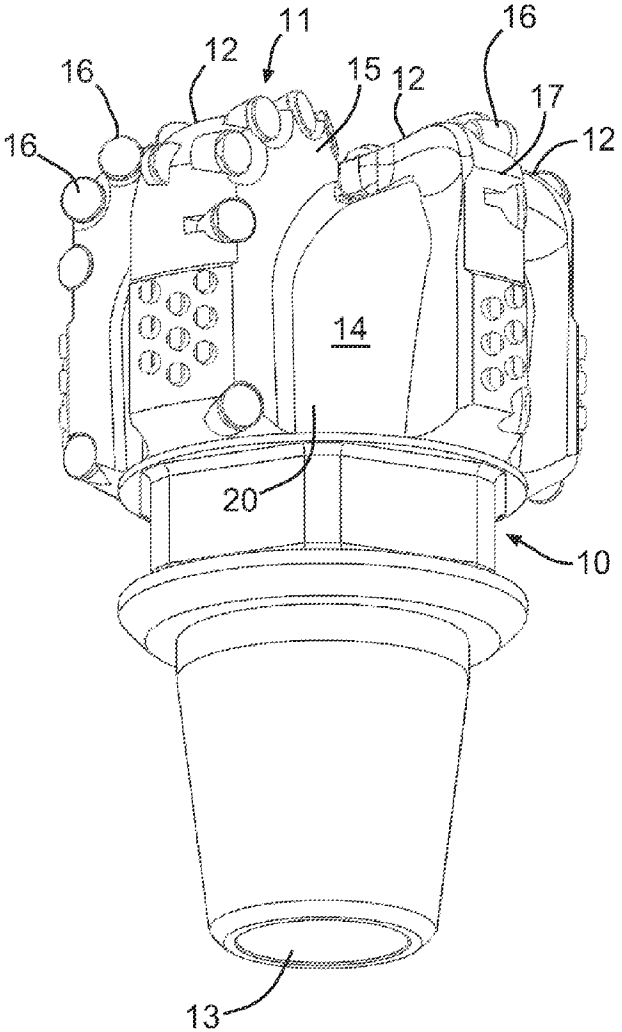
FIG. 2 is a side perspective view of the drill bit of FIG. 1.
Figure 1:
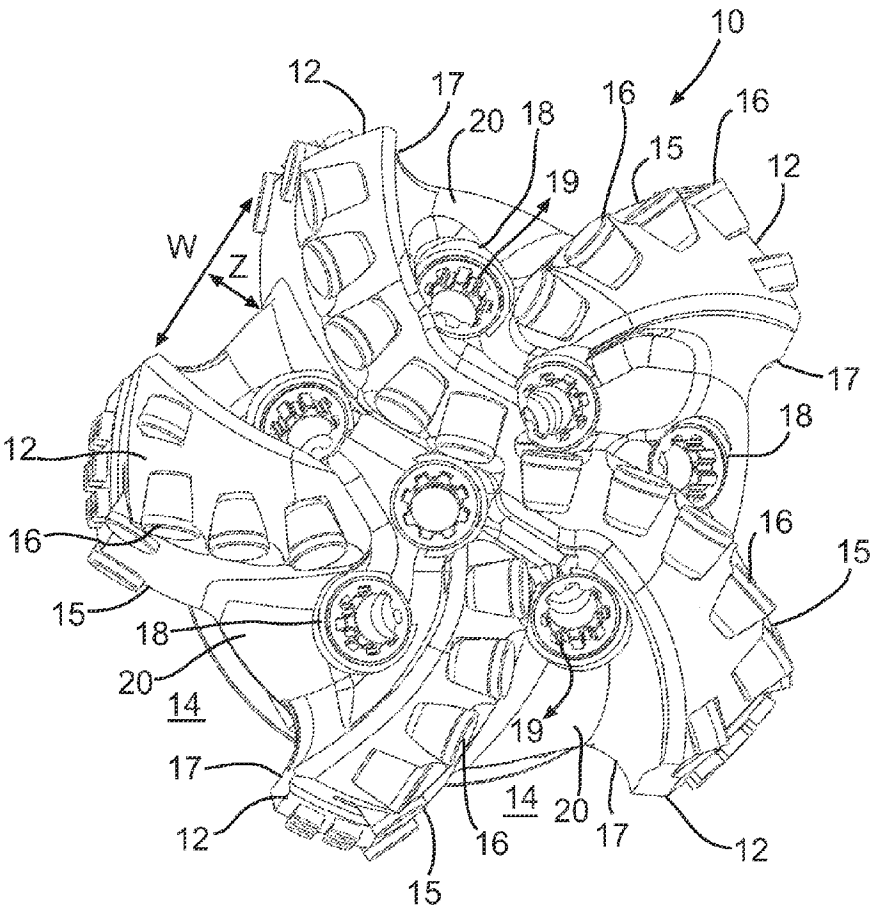
FIG. 1 is a top plan view of a drill bit 1.
Figure 3:
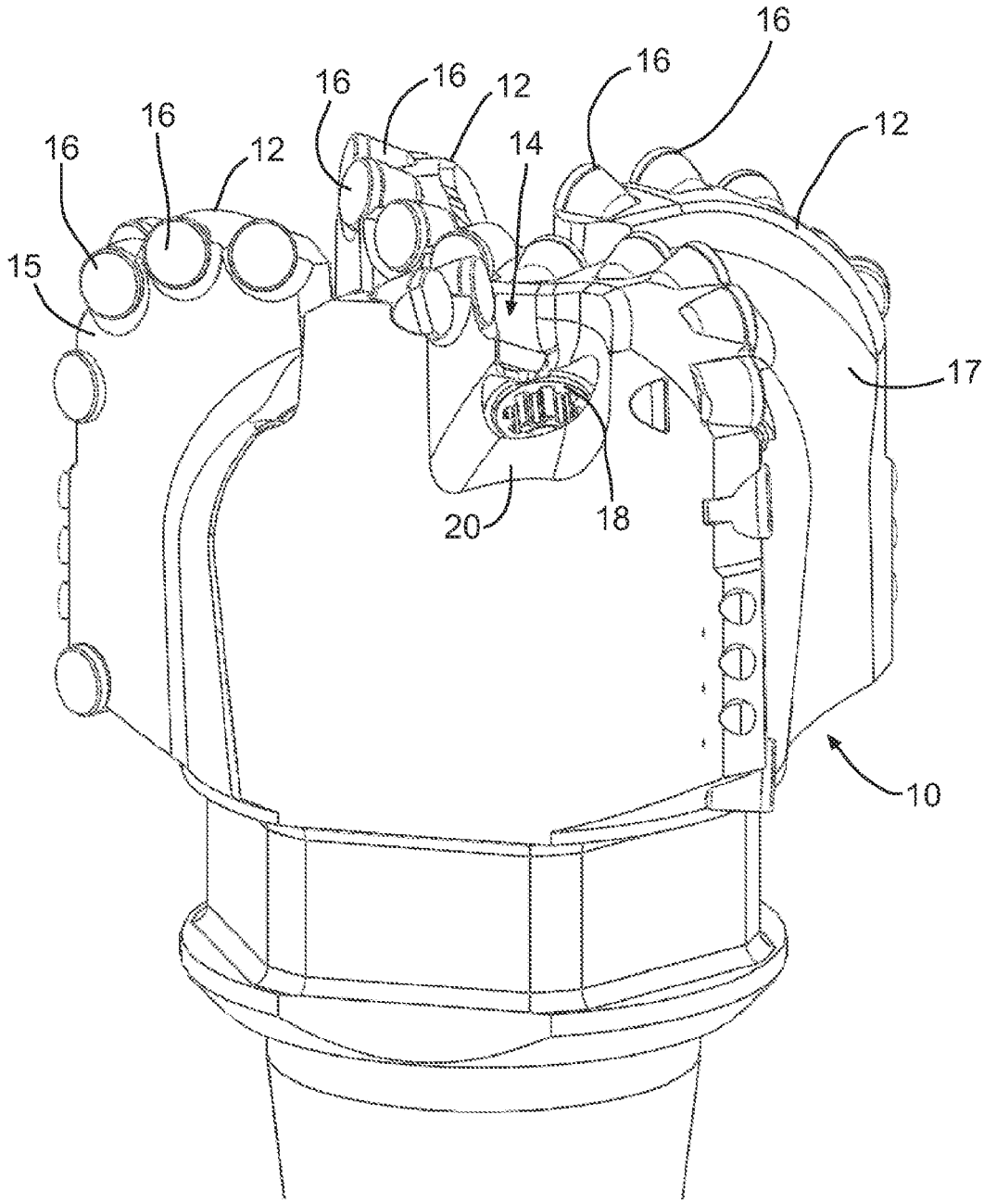
FIG. 3 is a side perspective partial cut-away view of the drill bit of FIG. 1.

Referring to FIGS. 1-3, a drill bit head 10 has a cutting end 11 formed of multiple cutting blades 12. Each pair of adjacent cutting blades 12 defines a flute 14 between the adjacent cutting blades 12. The cutting blades 12 and flutes 14 each extend radially outward from a central area of the drill bit head 10. As the cutting blades 12 extend radially outward, they may be slightly curved. Each cutting blade 12 has a front face 15 and a back face 17. The front face 15 is the face that faces forwards in the direction of rotation of the drill bit 10 in normal use and is the face that contains cutting elements. Each front face 15 of the cutting blades incorporates cutting elements 16. At least a nozzle 18 is formed at the base of each flute 14 and is directed towards a cutting element 16 on the corresponding front face 15 that defines a side of the flute 14 in which the nozzle 18 is formed. Each flute 14 defines a flow path for fluid moving along the flute in a flow direction. The flow from the nozzle 18 will flow across multiple cutting elements 16 as the flow expands outward from the nozzle, and the nozzle 18 will thus typically be directed at more than one of the cutting elements. Fluid is supplied to the nozzles 18 in conventional manner through a flow passage 13 that extends through the drill bit head 10. The cutting elements 16 may be conventional PDC cutters. There may also be more than one nozzle 18 in each flute 14.

Figure 8:
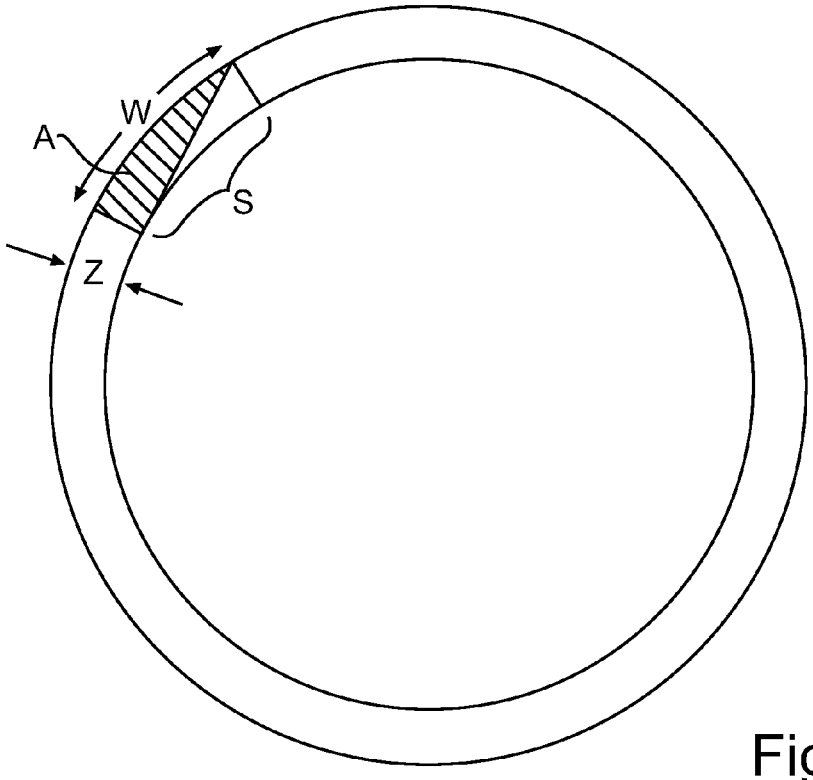
FIG. 8 is a diagram showing an annular segment corresponding to a drill bit flute present on the outer gage of the drill bit of FIG. 7.

Each flute 14 has a base 20, a depth Z (see also FIGS. 5A-5B) and circumferential width W (see also FIGS. 5A-5B) at a cutting element 16 towards which the respective nozzle 18 is directed. The depth Z is the maximum depth of the flute. Each flute 14 has a cross-section in a plane perpendicular to the flow direction, thus also perpendicular to the base and to the front face at the cutting element 16. The cross-section of the flute 14 is defined by the depth Z and circumferential width W of the flute 14. The cross-section of the flute, that is, the flow area of the flute, at a cutting element 16 is at least 15% smaller in area than the area of an annular segment having a constant radial depth and circumferential width equal to the depth Z and circumferential width W of the flute at the cutting element 16. An annular segment S having a constant radial depth Z and width W is shown in FIG. 8 along with the hatched cross-section A of a flute with a reduced cross-section.

Figure 9:
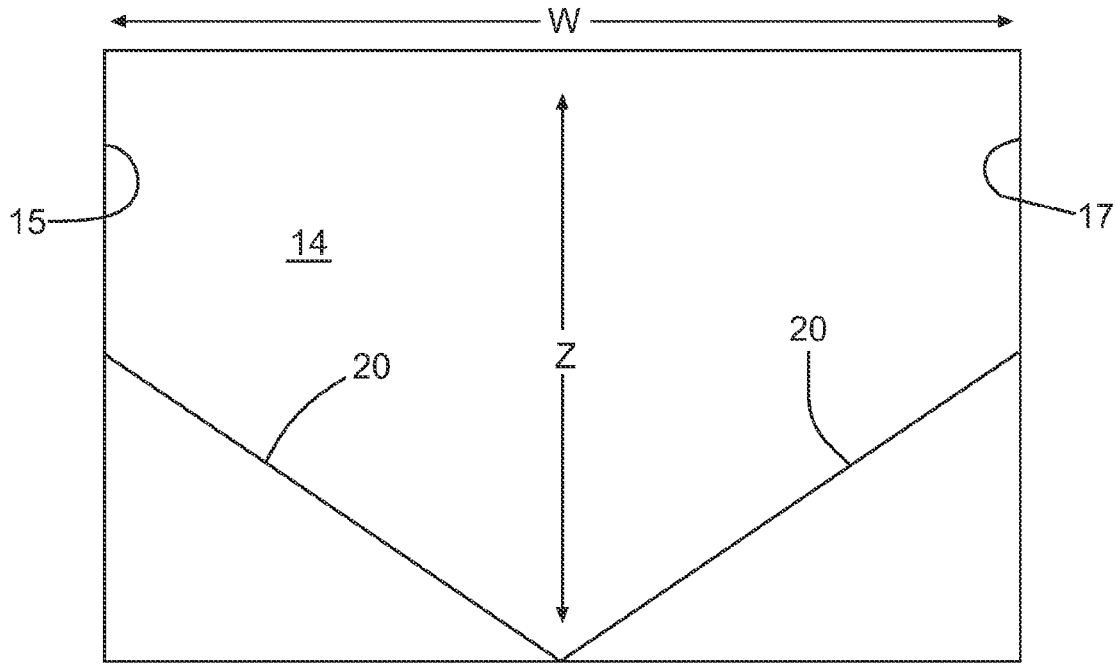
FIG. 9 shows a further cross-section of a flute.

In one embodiment, the reduced cross-section may be achieved by having the base 20 of a flute 14 slope upward from the front face 15 to the back face 17 of the respective blades that define the flute 14. The reduced cross-section increases the flow velocity of the jet from the nozzle 18 across cutting elements 16. Where the front face 15 of a blade 12 is sloped inward, corresponding to the point of maximum depth being more centrally located within a flute 14, the reduction in cross-section caused by the inward sloping cross-section is counted within the cross-section reduction. The front face 15 may also slope inwards toward the flute gradually from the top of the blade or in sloped segments as illustrated in FIG. 9 to form a flute that is defined by one or more triangular shapes, for example forming a pentagon or other polygon as shown in FIG. 9. In FIG. 9, the flute has a first portion that is rectangular (above the breaks in slope where the base 20 meets the front face 15 and back face 17 respectively) and a second portion that is triangular (below the breaks in slope). The flute 14 in any of these examples could terminate at any point above the breaks in slope, and if the flute terminated at the breaks in slope, then the flute would be entirely triangular in shape. In practice, breaks would be smooth, so that the defined shapes are approximate.

Each flute 14 therefore defines a volume having cross-sections (see areas demarked by lines L1-L6 for example in FIGS. 5A-5B) perpendicular to the flow of fluid (exemplary flow shown by arrows 19 in FIG. 2) through the flute 14. In this manner, the flow area available in the cross section is compressed or moved closer towards the cutting element 16. The deepest point of the flute 14 may occur at the base of the front face 15. The area of reduced cross-section preferably extends along each flute 14, in particular wherever a cutting element is present.

Figure 7:
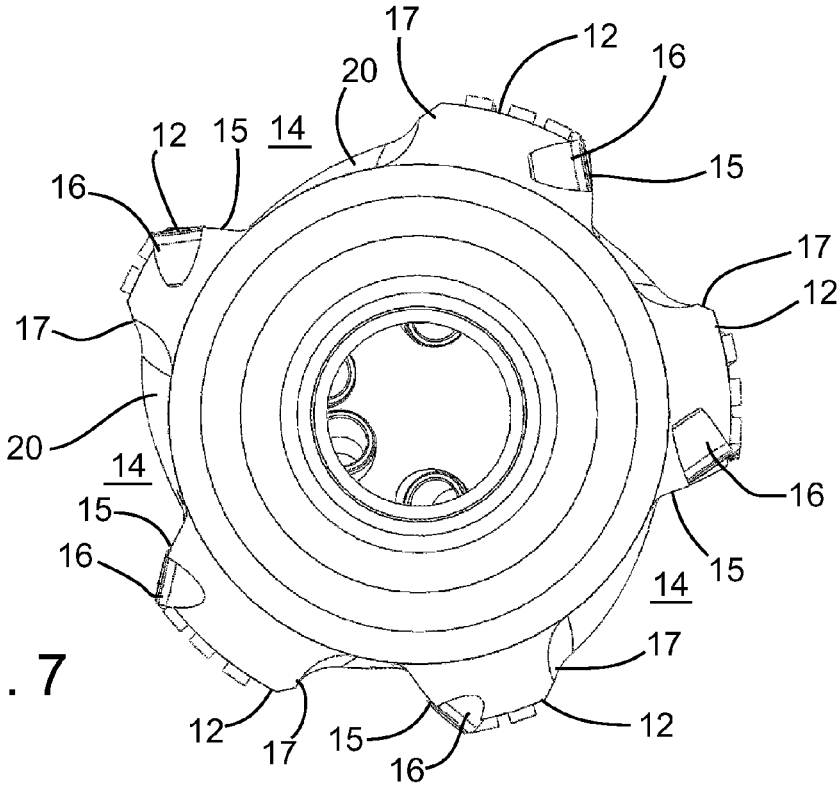
FIG. 7 is a bottom plan view of the drill bit of FIG. 1.

Referring to FIG. 7, looking at a PDC drill bit 10 from a bottom view the same concept is described at the break over from the flute 14 at the outer gage of the drill bit 10, where the flute may become or transfers to a junk slot. The junk slot may be designed with the same concepts in mind as the flutes disclosed herein.

Figure 4:
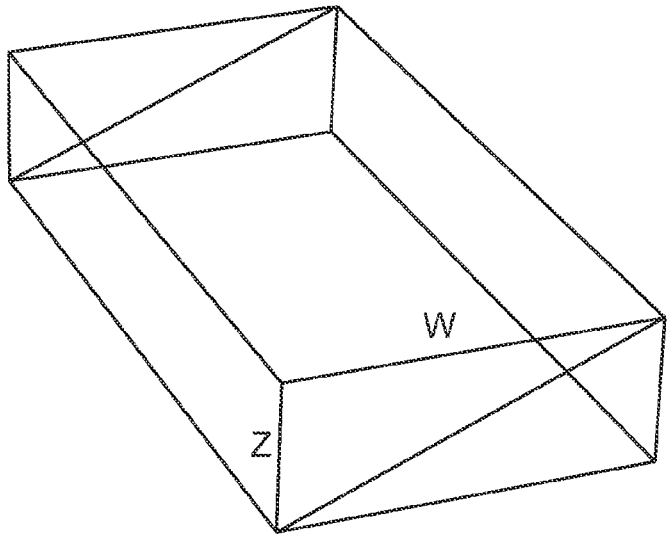
FIGS. 4 and 5A-B are various views that conceptually illustrate a cross-section of a drill bit flute of a drill bit.
Figure 5A:
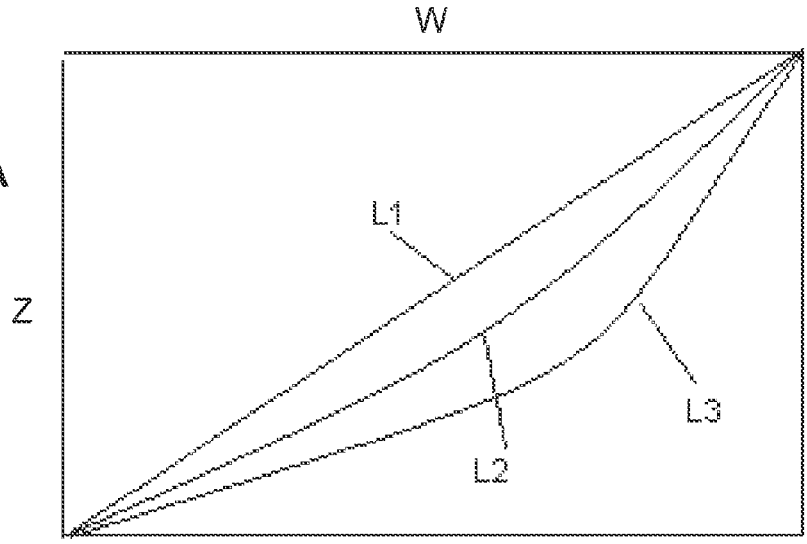
Figure 5B:
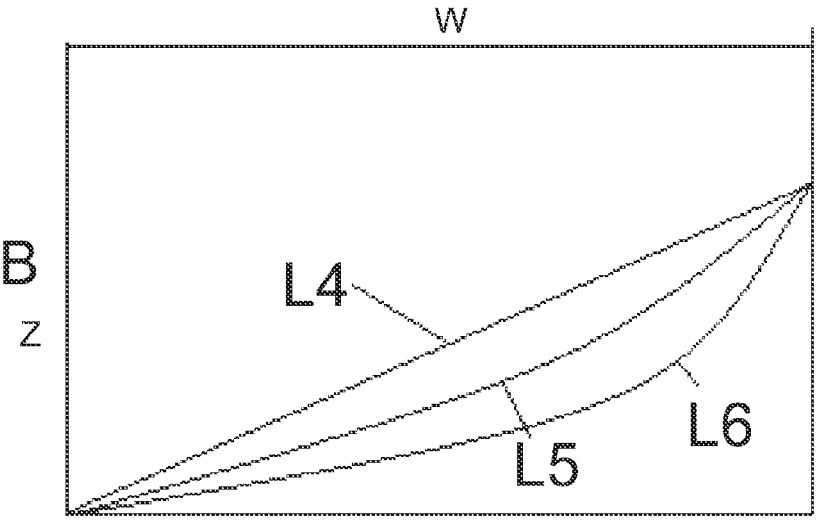

FIGS. 5A-5B show exemplary cross-sections of a flute 14. The cross-sections in FIGS. 5A-5B are simplified to rectangles, but represent real world annular segments as for example shown in FIG. 8. That is, the straight line W corresponds to a circumferential curve between adjacent blades of a drill bit. Likewise, the box of FIG. 4 illustrates a flow channel along a flute that in practice is curved, both between the blades and along the flute. By narrowing the flute by inserting a sloped base, such as a diagonal base, the cross-sectional area is reduced, in the case of FIG. 4 by a factor of approximately 50%. In FIGS. 5A and 5B, the sloped bases of the flute are illustrated by lines L1-L6, each corresponding to a different cross-sectional reduction. The lines L1-L3 corresponds to essentially triangular cross-sections, while the lines L4-L6 correspond to essentially trapezoidal cross-sections. The lines L1-L6 correspond to flow area reductions of 50%, 35%, 25%, 30%, 25% and 15% respectively. Other reductions are possible, such as 60%, 70%, 80% and 90% by increasing the slope of the base 20 as it extends away from the deepest point of the flute.

Since the fluid velocity is directly proportional to the flow rate divided by the cross-sectional area, this reduction of flow channel cross-section will increase the average fluid velocity through the flute resulting in better cutting removal, higher rate of penetration (ROP), and better cooling of the fixed PDC cutting elements. The increase in instantaneous ROP is mainly due to the faster removal of cutting so that fewer drilled cutting are reground. The better cooling of the cutting elements or PDC cutters results in the cutters wearing at a lower rate and therefore a maintaining a higher rater ROP, because the bit is less worn throughout the bit runs and the bit runs may be extended or may drill longer sections.

The same concepts disclosed herein may apply to the point of where the drilling fluid breaks over from flowing from across the bit face to where it flows up the junk slot area parallel with the drill string. This is illustrated in FIG. 7 and the same velocity calculations apply for improved velocity and cleaning.

FIGS. 6A and 6B illustrate that the streamlines (or the lines of constant fluid velocity) are arranged differently in a standard rectangular flute (FIG. 6B) to a flute within the embodiments disclosed herein (FIG. 6A). This is a result of the different cross-sectional areas, which will improve cutter cleaning with the new flute design. This may be mainly due to the properties of the drilling fluid being non-Newtonian in behavior.

The typical rectangular cross-section (FIG. 6B) has streamlines that are further apart, with no significant difference between the streamlines in front of a cutter blade or behind a cutter blade. The flute design in FIG. 6A, in addition to optionally having a higher average velocity, induces a more rapid velocity of fluid in front of the cutter blade (illustrated by D2) compared with flow at the opposite side of the flute (illustrated by D1), which improves the drill bit hydraulic and cleaning. This is illustrated by the fact that in FIG. 6A the distance between adjacent streamlines are closer together in front of the PDC cutter blade (D2) versus in the back of the blade (D1) where the streamlines are further apart. A higher velocity change in front of the cutter blade generates a more rapid removal of cuttings from the cutting element, in addition to providing better cooling to the cutters. Also shown in FIGS. 6A and 6B is the fact that in FIG. 6A, regardless of whether or not the flow area is reduced in size, the asymmetrical cross-section moves the center of gravity (COG) of the fluid flow closer to the cutting elements. Referring to FIG. 3, the cutaway illustration demonstrates this point, as the sloped base 20 ensures that flow will be more turbulent and faster at the cutting elements 16 than if flute 14 had a standard design.

By providing an asymmetrical cross-sectional flow area that targets the COG towards the cutting elements, improved cleaning is afforded. In embodiments where the overall flow area is not reduced from the standard flute design, improved cutter cleaning is still afforded, but with a reduced chance of plugging over embodiments that merely reduce the flow area to increase the flow velocity.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims. Immaterial modifications may be made to the embodiments described here without departing from what is covered by the claims.

What is claimed is:

1. A drill bit, comprising:

a drill bit head having cutting blades, each pair of adjacent cutting blades defining a flute between the adjacent cutting blades, the cutting blades and flutes each extending radially outward from a central area of the drill bit head and each cutting blade having a front face and a back face, each front face of the cutting blades incorporating cutting elements;

at least a nozzle in each flute directed at least in part towards one or more cutting elements;

each flute defining a flow path for fluid moving along the flute in a flow direction between a first blade having a front face and a second blade having a back face, and each flute having in cross-section perpendicular to the flow direction a sloping base, the sloping base having a slope of increasing depth in a direction from the back face of the second blade towards the front face of the first blade and ending at a point of maximum depth closer to the front face of the first blade than to the back face of the second blade, the depth of the point of maximum depth of the sloping base also being the maximum depth of the flute, and the flute having a circumferential width at each of the cutting elements towards which the respective nozzle is directed;

the cross-section perpendicular to the flow direction of each flute at each of the one or more cutting elements being at least 15% smaller in area than an annular segment having a constant radial depth and circumferential width equal to the maximum depth and circumferential width of the flute at the respective cutting element.

2. The drill bit of claim 1 in which cross-section is at least 25% smaller in area than the annular segment.

3. The drill bit of claim 1 in which cross-section is at least 30% smaller in area than the annular segment.

4. The drill bit of claim 1 in which cross-section is at least 35% smaller in area than the annular segment.

5. The drill bit of claim 1 in which cross-section is at least 25% smaller in area than the annular segment.

6. The drill bit of claim 1 in which the cross-section of the flute at each cutting element has a triangular shape.

7. The drill bit of claim 1 in which the cross-section of the flute at each cutting element has a trapezoidal shape.

8. The drill bit of claim 1 in which the reduction in flute cross-section extends along the length of the flute.

9. The drill bit of claim 1 in which the flute has a junk box section and the reduction in flute cross-section extends into the junk box section.

10. The drill bit of claim 1 in which the cross-section of the flute is formed by one or more triangular shapes.

* * * * *